US005620088A

United States Patent [19]

Martin et al.

[11] Patent Number: 5,620,088

[45] Date of Patent: Apr. 15, 1997

[54] PACKAGING ARRANGEMENT FOR CONTACT LENSES

[75] Inventors: Wallace A. Martin, Orange Park; Kornelis Renkema; Victor Lust, both of Jacksonville, all of Fla.

[73] Assignee: Johnson & Johnson Vision Products, Inc., Jacksonville, Fla.

[21] Appl. No.: 414,515

[22] Filed: Mar. 31, 1995

Related U.S. Application Data

[63] Continuation-in-part of Ser. No. 257,796, Jun. 10, 1994, which is a continuation-in-part of Ser. No. 146,754, Nov. 2, 1993, abandoned.

[51] Int. Cl.[6] ..... A45C 11/04; B65D 85/00

[52] U.S. Cl. ..... 206/5.1; 206/526; 206/820

[58] Field of Search ..... 206/497, 499, 206/526, 5.1, 820; D3/264; D9/415, 418

[56] References Cited

U.S. PATENT DOCUMENTS

| | | | |
|---|---|---|---|
| D. 357,115 | 4/1995 | Abrams et al. | D3/264 |
| D. 358,078 | 5/1995 | Abrams et al. | D3/264 |
| 2,917,216 | 12/1959 | Despres | 206/499 X |
| 3,545,605 | 12/1970 | Robins | 206/361 X |
| 3,605,374 | 9/1971 | Mueller et al. | 206/820 X |
| 3,872,966 | 3/1975 | Gordon et al. | 206/499 |
| 3,983,999 | 10/1976 | Morton | 206/526 X |
| 4,403,695 | 9/1983 | Raymoure et al. | 206/497 |
| 5,240,111 | 8/1993 | Yamashita et al. . | |
| 5,337,888 | 8/1994 | Morrison | 206/5.1 |

FOREIGN PATENT DOCUMENTS

| | | | |
|---|---|---|---|
| 604177 | 6/1994 | European Pat. Off. . | |
| 1065222 | 5/1954 | France | 206/526 |
| 2923106 | 12/1980 | Germany . | |
| 3446093 | 9/1986 | Germany . | |
| 8702305.9 | 6/1987 | Germany . | |
| 037000 | 7/1963 | Switzerland | 206/526 |
| 942393 | 11/1963 | United Kingdom . | |

*Primary Examiner*—Bryon P. Gehman

[57] ABSTRACT

A packaging arrangement for the containment of at least one hydrophilic contact lens in a sterile aqueous solution More specifically, pursuant to the packaging arrangement, a plurality of disposable hydrophilic contact lenses are contained in a specific number of individual packaging arrangements collectively housed in a box-like container or carton so as to provide a specified or essentially measured supply of contact lenses for use by a consumer over a predetermined period of time.

29 Claims, 12 Drawing Sheets

PACKAGING ARRANGEMENT FOR CONTACT LENSES

CROSS-REFERENCE TO RELATED PATENT APPLICATIONS

This application is a continuation-in-part patent application of Ser. No. 08/257,796, filed Jun. 10, 1994; which is a continuation-in-part of Ser. No. 08/146,754, filed Nov. 2, 1993, now abandoned.

BACKGROUND OF THE INVENTION

1. Field of the Invention

The present invention relates to a packaging arrangement for the containment of at least one hydrophilic contact lens in a sterile aqueous solution. More specifically, the invention pertains to a packaging arrangement wherein a plurality of disposable hydrophilic contact lenses are contained in a specific number of individual packaging arrangements adapted to be collectively and compactly housed in a box-like container or carton so as to provide a specified or essentially measured supply of contact lenses for use by a consumer over a predetermined and possibly lengthy period of time.

The packaging of hydrophilic contact lenses in a sterile aqueous solution is well known in the contact lens manufacturing technology. In particular, such packaging arrangements generally consist of so-called blister packages which are employed for the storage and dispensing of the hydrophilic contact lenses by a medical practitioner or to a consumer who intends to wear the contact lenses. Generally, such hydrophilic contact lenses, which may be disposable after a single wear or short-term use, are manufactured from suitable hydrophilic polymeric materials. These materials may be, amongst others, copolymers of hydroxyethyl methacrylate containing from about 20% to 90% or more of water, depending upon the polymer composition. Generally, such contact lenses must be stored in a sterile aqueous solution, usually in isotonic saline solution in order to prevent dehydration and to maintain the lenses in a ready-to-wear condition.

2. Discussion of the Prior Art

Heretofore, contact lens manufacturers normally utilized stoppered glass bottles containing sterile saline solutions in which the hydrophilic contact lenses were immersed as storage and shipping containers for individual contact lenses. Each bottle was sealed with a suitable silicone stopper and provided with a metal closure as a safety seal in the configuration of an overcap. When the contact lens was intended to be removed from the bottle for use by a patient, the metal closure safety seal was required to be initially torn off the bottle, thereafter the stopper withdrawn and the lens lifted out from the bottle through the intermediary of a suitable plastic tweezer or pouring the contents out. This entailed the implementation of an extremely complicated procedure, since the contact lens was difficult to grasp and remove from the saline solution contained in the bottle due to the transparent nature of the contact lens which rendered it practically invisible to the human eye.

More recently, containments in the form of blister packages have been developed for hydrophilic contact lenses, and which enable the storage and shipping of the hydrophilic contact lenses in a simple and inexpensive expedient manner, while concurrently facilitating the conveniently easy removal of the contact lens by a practitioner or a patient.

For instance, a blister package which is adapted to provide a sterile sealed storage environment for a disposable or single-use hydrophilic contact lens, wherein the lens is immersed in a sterile aqueous solution; for example, such as in an isotonic saline solution, is described in U.S. Pat. No. 4,691,820 to Martinez; which is assigned to the common assignee for the present invention, and the disclosure of which is incorporated herein by reference.

Thus, in the above-mentioned U.S. patent, the blister package for storing and dispensing a hydrophilic contact lens includes an injection-molded or thermoformed plastic base portion incorporating a molded cavity which is surrounded by an outstanding planar flange about the rim of the cavity. A flexible cover sheet is adhered to the surface of the flange so as to sealingly enclose the cavity in a generally liquid-tight mode. Within the cavity of the base portion, a hydrophilic contact lens is immersed in a sterile aqueous solution, such as an-isotonic saline solution. A portion of the side wall of the cavity is inclined to form a ramp extending upwardly towards the flange from the bottom of the cavity, and the cover sheet is adapted to be stripped from the flange in order to expose the cavity and inclined side wall whereupon the lens may be readily manually removed by being slid upwardly and out of the cavity along the inclined ramp surface of the cavity.

Although the foregoing blister package construction for the containment of contact lenses clearly provides a significant advance over prior structures requiring glass bottles and removable stopper arrangements for housing the contact lenses, the present invention further improves upon the uses and versatility of blister package construction in that the cavity is essentially of a semi-spherical configuration dimensioned so as to be adapted to closely support the contact lens therein immersed in an aqueous solution for ease of removal and also to facilitate an inspection process. Moreover, the foregoing construction primarily considers the utilization of such blister packages for the dispensing of individual contact lenses, with such blister packages being ordinarily separate or single packagings, which may then be housed in larger quantities in a further container, such as a rigid cardboard or paperboard carton of usual construction employed for the retail sales of the lenses.

Accordingly, it is an important aspect to be able to furnish a user of such disposable hydrophilic contact lenses with a specific supply of contact lenses, the latter of which are normally worn for only a single day; in essence, for ordinarily 8 to 18 hours within a 24-hour period and thereafter discarded. Hereby, the packaging of a supply of contact lenses should enable the user to store and provide indication for replenishing the supply of contact lenses at regular intervals; for example, at periods of 30 days, although pursuant to the invention, it is also possible to contemplate providing packages containing supplies of the contact lenses for shorter or considerably lengthier periods of days. Consequently, the present invention contemplates the provision of packaging arrangements for specified quantities of such hydrophilic contact lenses, wherein these packaging arrangements are boxed enabling a rapid and precise determination as to the quantity of hydrophilic contact lenses contained therein, and with the blister packages being shaped to enable large quantities to be stored in carton-like packaging arrangements of a compact nature which is completely protective of the hydrophilic lenses, while avoiding them being unwieldy in sizes and external dimensions.

SUMMARY OF THE INVENTION

In essence, the inventive concept pertains to packaging arrangements in which a plurality of blister packages each having a preferably, although not necessarily, semi-circular cavity containing respectively one hydrophilic contact lens in a sterile aqueous solution. A specified quantity of such blister packages has molded plastic base members thereof each containing a contact lens positioned in a contiguous array, and with the array or possibly each base member individually being covered by a single flexible cover sheet constituted of a laminated foil or plastic film incorporating a silicon oxide barrier material, or other suitable covering material structure to provide a sealed environment for each of the contact lenses contained in the cavity formed in each base member. Weakening lines are formed in the flexible cover sheet intermediate adjoiningly located base members to enable detachment from the array of individual blister packages containing one of the hydrophilic contact lenses as may be required by a user.

In particular, a plurality of such arrays of continuous packaging arrangements for contact lenses, which arrays may be in an interconnected planar form, are adapted to be arranged superimposed in a generally rectangular container or carton. Each successively superimposed array is inverted and rotationally reversed relative to a preceding underlying array so as to enable the respective arrays to be interleaved and compactly nestingly support each other. The cavities containing the contact lenses of a superimposed array are arranged inverted relative to the cavities of an array of blister packages located therebeneath or thereabove, such that the mutually inverted cavities will be positioned adjacent to cavities of a superimposed array in an interleaved compact arrangement at minimum spacial requirements. Consequently, a plurality of planar arrays of blister packages which are each respectively interconnected by a single flexible cover sheet for each array are adapted for compact positioning in a superimposed contacting relationship within a substantially rigid rectangular container or carton, with such arrays containing a specific quantity of disposable hydrophilic contact lenses to furnish a user with a desired supply; for instance, thirty (30) hydrophilic contact lenses in six superimposed arrays of five blister packages each; in essence, a thirty-day supply of contact lenses, although other and even considerably larger quantities may be readily considered; for instance, such as a three-month supply of about 96 lenses.

Each of the blister package base members, which may be of injection molded or thermoformed plastic material, in order to reduce or miniaturize the size thereof, has an outstanding substantially rigid planar flange encompassing a respective lens-receiving cavity molded therein, the latter of which is offset towards one end of the flange. The planar flange as disclosed herein, pursuant to a preferred embodiment, has a generally wedge-shaped configuration; in effect, two converging side walls, the opposite ends of which extend into semi-circular or convexly curved end walls, and also may possess a bent tab at one end or other deviating shapes. However, numerous other shapes readily lend themselves to the invention, and the blister packages may have diverse configurations as disclosed; for instance, in copending U.S. patent application Ser. No. 08/414,514 (Attorney's Docket No. VTN-171, 9014Z-III), commonly assigned to the assignee of this application and the disclosure of which is incorporated herein by reference. The lens-receiving cavity is formed towards the larger end of each planar flange, as described hereinbelow. The presence of the flange is adapted to provide a support for a superimposed or alternatively therebeneath located array of blister packages, thereby formulating rigid and compact packaging arrangements within the carton, in which the cavities containing the hydrophilic contact lenses of superimposed arrays are substantially protected against potentially damaging external influences, such as shocks or impacts which may be imparted to the filled carton during handling thereof. The unique wedge-like or teardrop shape of the flange, which considerably reduces the size of the base member of the blister package, not only miniaturizes the overall dimensions of a packaging array in comparison with base members possessing rectangular flanges, thereby facilitating the packaging of larger quantities of blister packages in comparatively smaller secondary packagings, such as cartons, but also result in considerable savings in the materials for producing such blister packages. This, of course, renders the manufacture thereof much more economical, considering the large quantities of such articles being produced.

Each molded plastic base member of a blister package may be constituted from a suitable injection molded or thermoformed thermoplastic sheet material, such as a polyolefin, for instance polypropylene; whereas the flexible cover sheet may be constituted of a laminate of a thermoplastic film and aluminum foil or a barrier material comprising silicon oxide, suitably imprinted and which is adapted to be heat-sealed to the flange extending about the cavity of the package containing the hydrophilic contact lens. The flexible cover sheet may be of a construction and imprinted in a novel manner as is disclosed, for example, in copending U.S. patent application Ser. No. 08/106,386; filed on Aug. 13, 1993; entitled "Method of Double-Sided Printing of a Laminate and Product Obtained Thereby", commonly assigned to the assignee of the present application and the disclosure of which is incorporated herein by reference.

Accordingly, it is an object of the present invention to provide a packaging arrangement for hydrophilic contact lenses, wherein a plurality of lenses are located in essentially reduced-size base members of blister packages which are interconnected by a common flexible cover sheet to form an array of such packages which are adapted to be compactly packaged in carton structures.

A more specific object of the invention is to provide a packaging arrangement for a plurality of hydrophilic contact lenses in which a plurality of wedge-like or teardrop-shaped blister packages each having a semi-spherical cavity containing one of the contact lenses in a sterile aqueous solution are interconnected in an array by a single flexible cover sheet containing weakening lines intermediate the base members of the blister packages enabling separation of individual of the blister packages from the array to facilitate dispensing the contact lens from the separated blister package.

Another object of the present invention is to provide an arrangement for the storage of a plurality of superimposed and inverted interleaved arrays of blister packages compactly positioned within a substantially rigid carton structure possessing minimal external dimensions.

Yet another object of the present invention is to provide a uniquely configured flanged base member structure for blister packages of the type described for the storage of hydrophilic contact lenses in a sterile aqueous environment, wherein pluralities of arrays of essentially miniaturized blister packages are arranged in specified mutually inverted superimposed and interleaved or nested orientations for compact containment within a carton or box-like structure which are adapted to house large supplies of contact lenses for extended periods of use by a consumer.

BRIEF DESCRIPTION OF THE DRAWINGS

Reference may now be had to the following detailed description of preferred embodiments of a packaging arrangement for contact lenses constructed pursuant to the invention, and taken in conjunction with the accompanying drawings; in which.

DETAILED DESCRIPTION OF PREFERRED EMBODIMENTS

Figure 1:
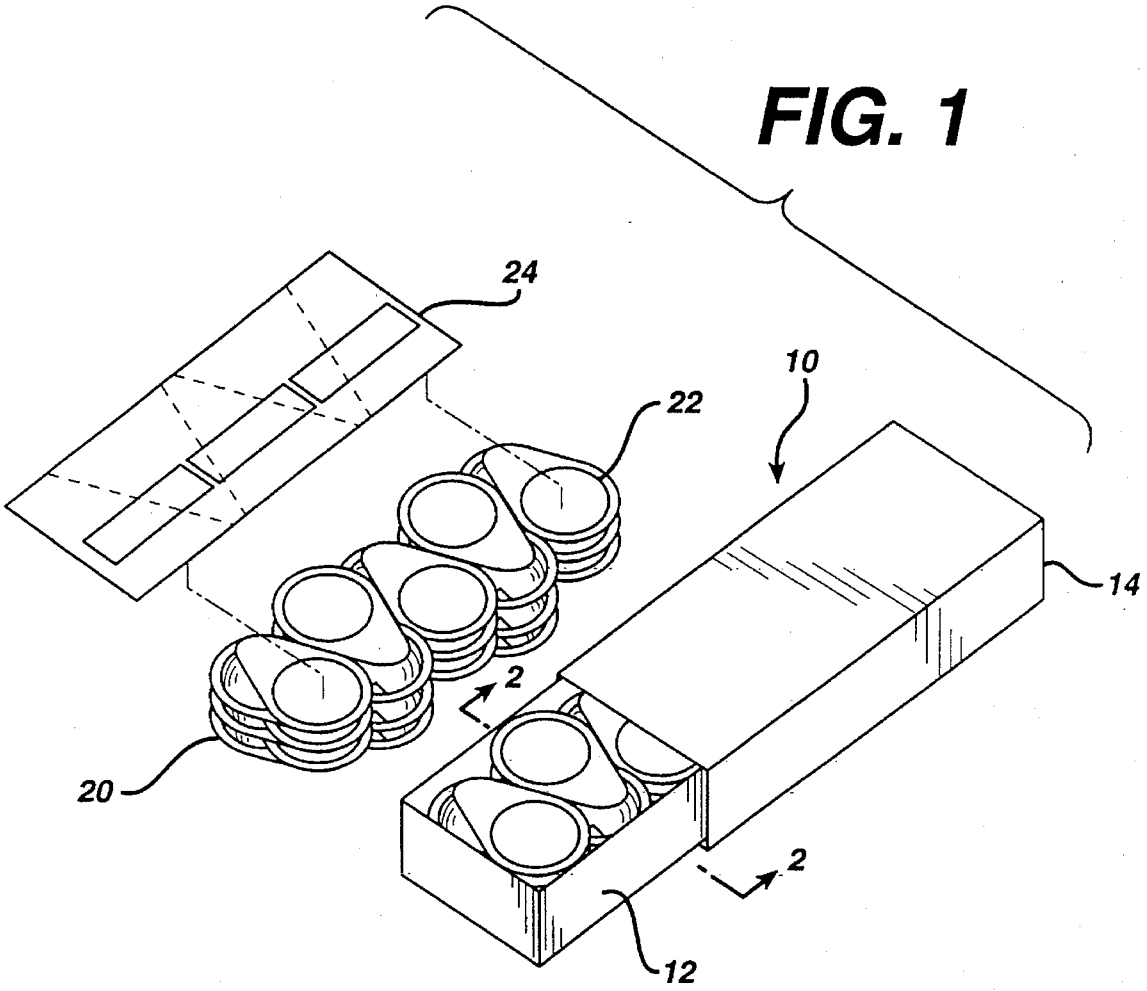
FIG. 1 illustrates, in an exploded perspective view, a plurality of superimposed arrays of packaging arrangements or blister packages pursuant to the invention for a specific quantity of contact lenses adapted to be stored in a suitable carton-like container.
Figure 2:
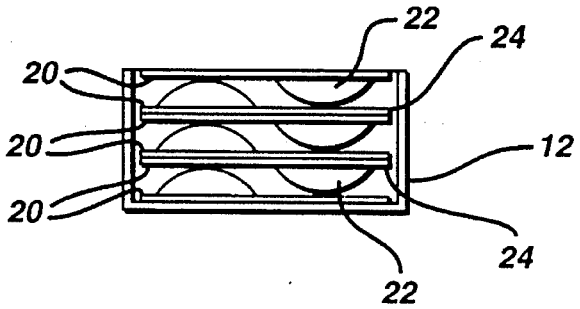
FIG. 2 illustrates a sectional view taken along line 2—2 in FIG. 1.

Referring now more specifically to the drawings, and in particular to FIGS. 1 and 2, there is diagrammatically illustrated a rectangular carton 10, shown in a partially opened condition, wherein the carton 10 includes a lower or inner portion 12 having a storage space for the receipt of arrays of blister packages, including a top opening and incorporating side and end walls extending upwardly from a flat bottom wall, as known in the carton art, and which is adapted to be enclosed by a sleeve-like outer carton portion 14. The rectangular carton 10 is preferably constituted of paperboard as is well known in the carton manufacturing technology and is dimensioned so as to be able to receive a specified quantity of planar arrays of packaging arrangements for the sealed containment of contact lenses, especially disposable hydrophilic contact lenses (not shown), as described in more specific detail hereinbelow; although other materials, such as pressed cardboard, plastic and even more rigid durable materials, can be contemplated.

Furthermore, although shown as a so-called "matchbox" carton, the latter may be a carton having an openable lid or cover portion; for example, as disclosed in copending U.S. patent application Ser. No. 08/146,754 (Attorney's Docket No. VTN-90, 9014), the disclosure of which is incorporated herein by reference.

As is illustrated, the carton 10, as is known in the art may be provided with a decorative glossy or semi-glossy exterior surface, which may be imparted with suitable single or multi-colored imprinting and/or embossing representative of the product contained therein identifying legends and logos pertaining to the company manufacturing and/or marketing of the product, instructions pertaining to the use of the product packaged in the carton, and other suitable legends including product batch numbers and manufacturing dates and other decorative indicia and the like.

As is shown in the exploded perspective view of FIG. 1 and also in the sectional view shown in FIG. 2 of the drawings, a plurality of arrays 20 of interconnected blister packages is located in the lower carton portion 12. Each blister package 22 of an array 20, as represented in further detail hereinbelow, includes a base member consisting of a planar essentially wedge or teardrop-shaped flange having semi-circularly outwardly curved end portions, and wherein off-set towards the wider end of the planar flange, there is formed a cavity of an essentially semi-spherical configuration. However, as disclosed in copending U.S. patent application Ser. No. 08/414,514 (Attorney's Docket No. VTN-171, 9014Z-III), other flange configurations are to be considered herein, and the above-mentioned shape is to be deemed as being only exemplary in nature. Generally the cavity is configured in conformance with the curvilinear shape of a contact lens (not shown), adapted to be stored therein a sealed condition while immersed in a suitable sterile aqueous solution.

Figure 1A:
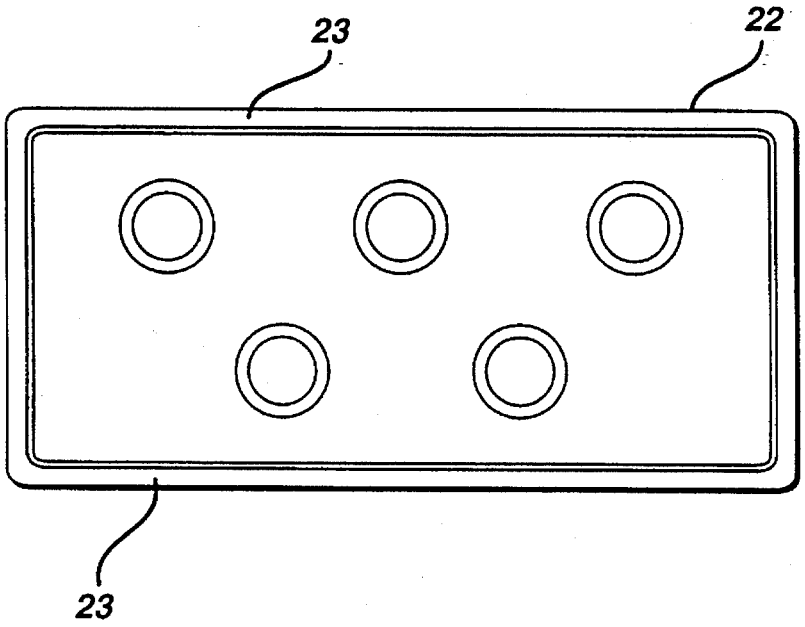
FIGS. 1*a* and 1*b*, respectively, illustrate different embodiments of blister packages pursuant to the invention.

Referring to FIG. 1*a* of the drawings, the blister packages 22 are essentially constituted of a plurality of lens-receiving cavities, and are injection molded or thermoformed as an integral unit, in this instance of an essentially rectangular construction. In this case, five cavities for receiving each a contact lens are molded in a manner similar to the array of FIG. 1, and are adapted to be sealingly covered by flexible cover sheet 24, which includes suitable weakening lines or perforations to enable access to individual of the cavities for removal of the contact lens therefrom. Proximate the perimeter of the base member 22 incorporating the respective plurality of cavities, there is provided, as an optional aspect, a molded rib structure 23 at the bottom surface to add additional rigidity to the integrally formed base member containing the plurality of cavities.

Figure 1B:
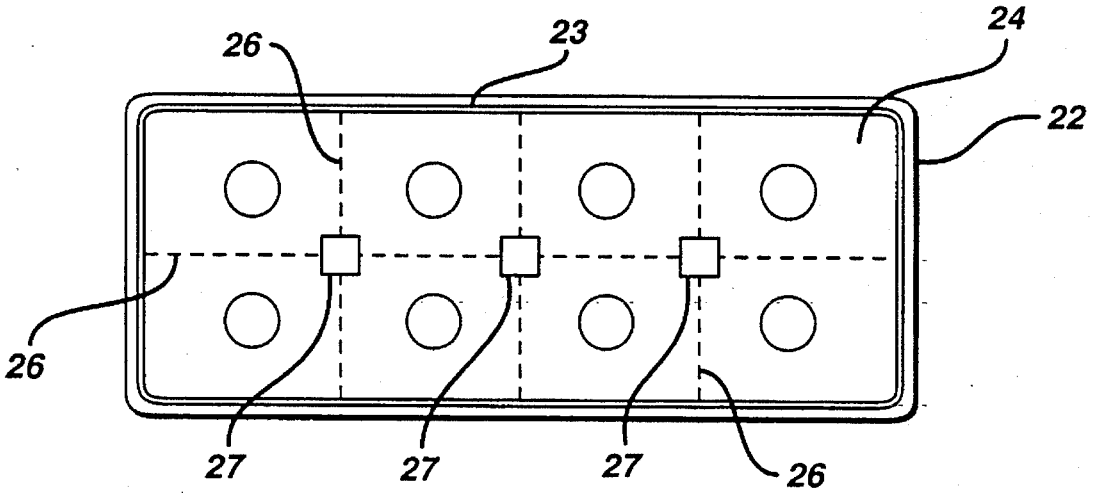

With respect to the embodiment of FIG. 1*b* of the drawings, which is somewhat similar to that of FIG. 1*a*, in this instance four cavities, in two rows each for a total of eight lens-receiving cavities, are molded into the base member 22 which is of unitary molded or thermoformed construction, and which may also have an encompassing stiffening rib 23 molded in the lower surface thereof to provide additional rigidity and strength thereto. The entire integral base member containing the plurality of lens-receiving cavities may be sealingly covered by a flexible cover sheet 24 which, in this instance, has weakening lines or perforations 26 adapted to be removed in sections to provide selective access to individual of the cavities for removing the contact lens therefrom. Each of the weakening lines 26 at the intersections thereof may be provided with suitable areas 27 of non-sealing property to enable the user to grippedly engage that portion of the flexible cover sheet and detach that segment from the remaining cover sheet so as not to adversely influence the integrity of the contact lenses sealingly contained in the remaining cavities.

However, other lens-receiving cavity configurations also readily lend themselves to the invention, such as hemispherical, oval, rectangular or the like.

Figure 3:
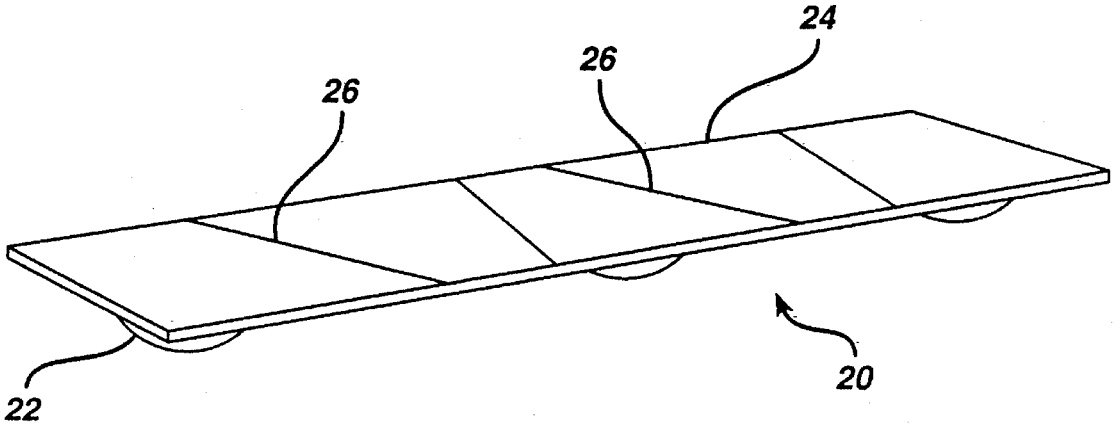
FIG. 3 illustrates a perspective view of a single array of a plurality of detachably interconnected teardrop-shaped blister packages each containing respectively one contact lens immersed in a sterile aqueous solution.
Figure 4:
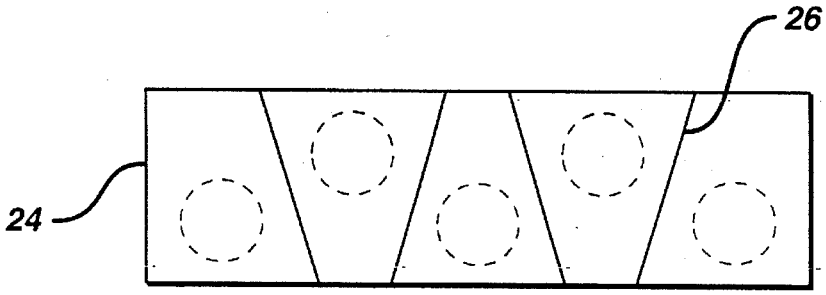
FIG. 4 illustrates a top plan view of the array of blister packages of FIG. 3.
Figure 5:
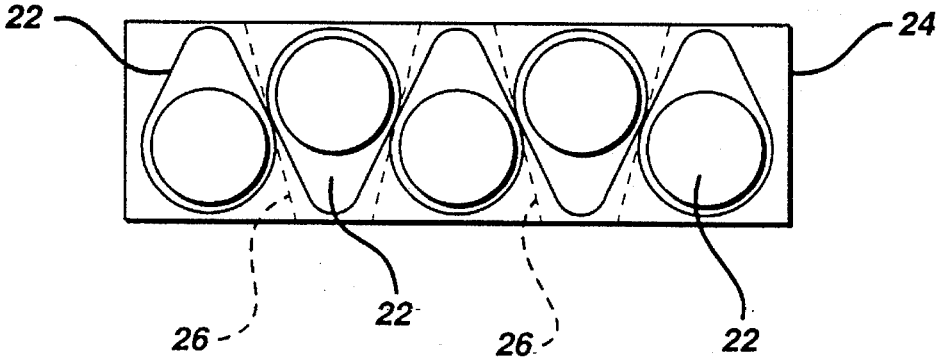
FIG. 5 illustrates a bottom view of the array of blister packages of FIG. 3.
Figure 6:
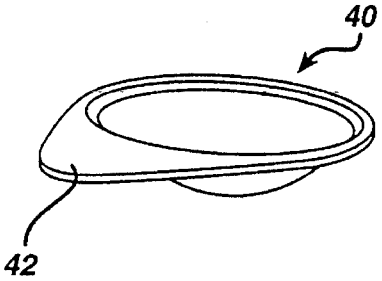
FIG. 6 illustrates a top and side perspective view of a base member for a teardrop-shaped blister package.
Figure 7:
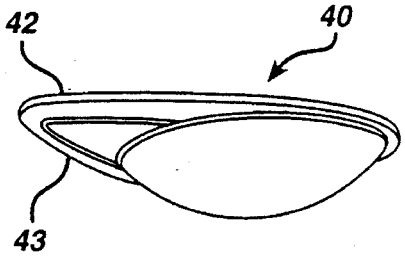
FIG. 7 illustrates a bottom and side perspective view of the base member of FIG. 5.
Figure 8:
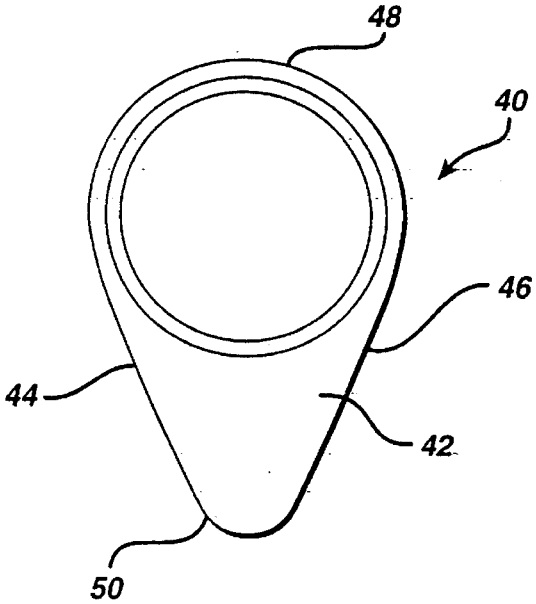
FIG. 8 illustrates a top plan view of the base member of the blister package.
Figure 9:
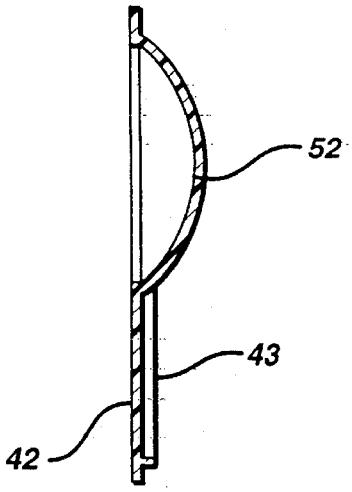
FIG. 9 illustrates a sectional view taken along line 9—9 in FIG. 8.
Figure 10:
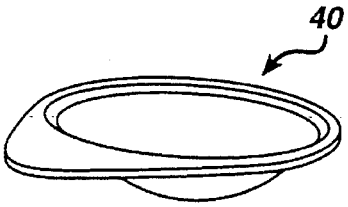
FIG. 10 illustrates a top and side perspective view of a base member of a blister package pursuant to a second embodiment.
Figure 11:
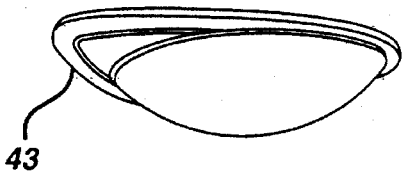
FIG. 11 illustrates a bottom and side perspective view of the base member of the blister package of FIG. 10.
Figure 12:
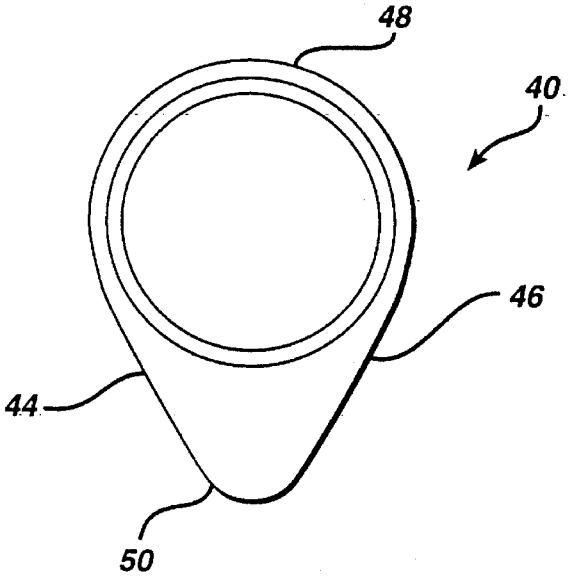
FIG. 12 illustrates a top plan view of the base member of FIG. 10.
Figure 13:
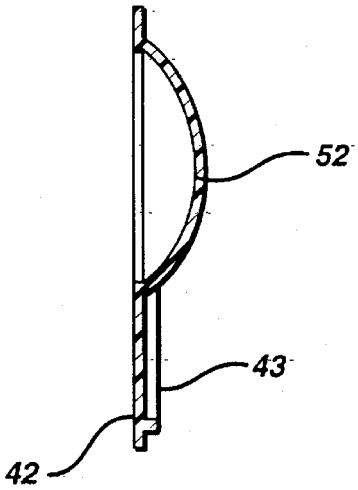
FIG. 13 illustrates a sectional view taken along line 13—13 in FIG. 12.

A plurality of the blister packages 22 arranged in reverse oriented order and in coplanar relationship, as shown in FIGS. 3 to 5, may be sealingly covered by a flexible cover sheet 24, the latter of which is provided with a series of weakening lines 26, such as perforations, discontinuous slits or the like, so as to extend between each of the adjacently located base members of each blister package. This will enable a suitable detachment, from the array 20, of individual blister packages 22, each containing a single contact lens. The flexible cover sheet 24 is adhesively fastened to suitable regions of the surface of the flanges of each base member of a blister package facing the cover sheet, such as by heat sealing, ultrasonic sealing, adhesives or other acceptable methods so as to at least encompass in a sealing manner each cavity containing a respective contact lens immersed in a sterile aqueous solution and to provide a sealing containment for each contact lens in its respective cavity. Other sealing locations may be provided in suitable areas or points as desired between the facing surfaces of the flexible cover sheet and that of the flange of each base member so as to provide adequate regions of adherence therewith, while permitting various edge portions between the flexible cover sheet and flange components to remain unattached in order to facilitate a finger-gripping engagement and enable separating the severed cover sheet portion from its associated base member, thereby providing for access to the contact lens which is contained in the applicable cavity thereof.

The flexible cover sheet is preferably constituted of a laminated foil, barrier film layered to other plastic, metalized or further layers, or other suitable material structure; for example, comprising a polypropylene film, possibly a PET film, on at least one external surface thereof adapted to contact the facing surface of the flange of each respective base member of a blister package 22, so as to enable adhesive or heat sealing therewith, as mentioned thereof. The laminated foil constituting the flexible cover sheet may be of a multi-layered construction having suitable double-sided imprinting provided thereon; for example, as disclosed in copending U.S. patent application Ser. No. 08/106,386, which is commonly assigned to the assignee of the present application.

As disclosed herein, as shown in FIGS. 1 and 2 of the drawings, the inventive packaging arrangement is adapted to provide for a packaged supply of large quantities of disposable hydrophilic contact lenses, each of which is intended to be used for only a specified period of hours within a single day, and then discarded; in effect, requiring the carton to be able to store contact lenses each in a sterile sealed condition in each one of the cavities of the respective blister packages so as to be individually dispensable.

Different sizes of carton constructions, each containing various specified quantities of arrays of blister packages with each having respectively a contact lens immersed in a sterile aqueous solution, may be provided in accordance with specific requirements of consumers. Thus, there may be provided different numbers of arrays of contact lenses varying in quantity and positioning within any specific carton so as to provide supplies of lenses for a consumer for various lengths of time extending over periods of days, weeks or even months, as elucidated hereinbelow in more specific detail.

As represented in the present instance, by way of example and having specific reference to FIG. 2, there are shown six arrays 20 each of five blister packages 22 interconnected by a single cover sheet 24, which are respectively superimposed interleaved inverted positions, so as to provide for a supply of 30 contact lenses, boxed in the carton 10.

As illustrated in FIGS. 3 to 5, the generally teardrop-shaped flanges of each base portion of a respective blister package 22 are arranged in relatively reversed alternating positions, having specific reference to FIG. 5, so that the cavities therein are each offset relative to each other; in effect, adjacent to narrower end of a contiguous base member, and to thereby permit the tapered or converging side walls of each base member to be positioned closely adjacent to an adjoining side wall of a contiguous blister package base member while oriented in an opposite direction, so as to impart a minimum overall dimension to the array 20.

The surfaces of the planar flanges in which the cavities are formed are then sealingly covered, as mentioned hereinbefore, by means of the single sheet of the flexible cover 24, and in which a plurality of weakening lines 26 are formed so as to extend generally coextensive along the lines of contact between the individual base members of the blister packages and to thereby produce a generally zig-zag pattern of weakening lines constituting generally triangularly-shaped cover sheet segments 28 upon being separated from each other with the exception of the opposite end segments 30, 32 which may have excess material in order to form the overall rectilinearly shaped arrays 22 in the carton 10; or possibly other potentially more appealing designs which could readily be custom die cut.

As illustrated in FIG. 2 of the drawings, vertically stacked arrays of blister packages 22 are inverted relative to each other and positioned so as to provide interleaving and nesting of the various base members of superimposed arrays, and which will provide for maximum savings in space, or in effect, miniaturization of the size of the arrays, and an inherently intense rigidity in positioning these plurality of arrays 20 within the carton 10.

Referring more specifically to the embodiment of a base member 40 as typically illustrated, for producing each array, and as shown in FIGS. 6 to 9 of the drawings, a planar flange 42 possesses a configuration having converging side walls 44, 46 extending along opposite sides of a longitudinal centerline, wherein the walls 44, 46 may be either straight or slightly outwardly curved. At a wider space portion between the walls, these extend into a generally hemispherical convex end 48, and also a convexly rounded end 50 at the narrower end portion thereof. Formed in the flange surface and offset towards the wider end 48 of the planar flange 42 and essentially having a center point coinciding with the center of curvature of the wider end portion 48 is a curvilinear depression forming a cavity 52, as shown specifically in FIG. 9 of the drawings, adapted to receive a similarly-shaped contact lens (not shown) immersed in a sterile saline solution. Moreover, the bottom surface of flange 42 may be provided with a rib or depression 43 extended along or proximate the periphery thereof so as to impart added strength and stiffness to the base member 40.

Figure 14:
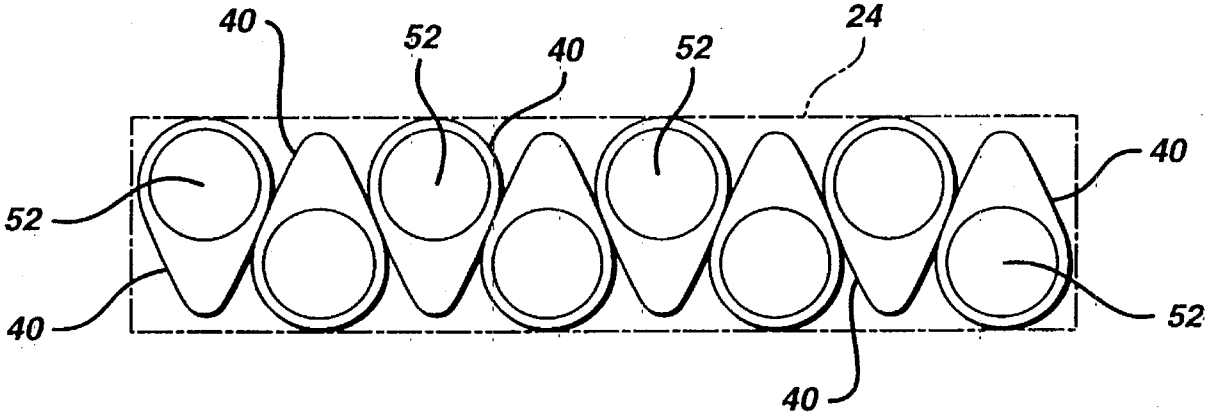
FIG. 14 illustrates a top plan view of an array of blister packages pursuant to the invention.
Figure 16:
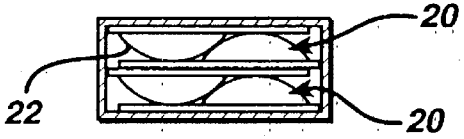
FIG. 16 illustrates a sectional view taken along line 16—16 in FIG. 15.
Figure 15:
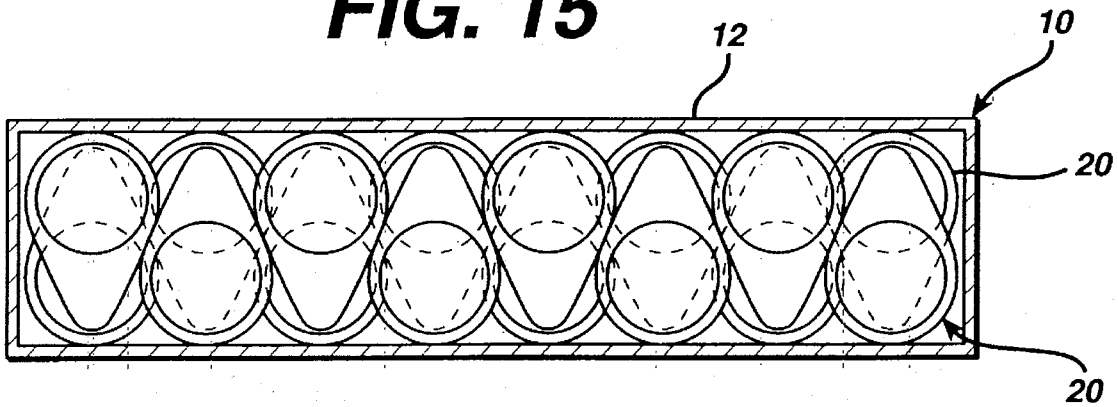
FIG. 15 illustrates diagrammatically a plurality of superimposed and inverted interleaved layers of arrays of blister packages as arranged within a carton structure.

A plurality of such these base members 40 for the blister packages 22 are then arranged in an alternatively reverse arrangement adjacent each other, as shown in FIG. 14, so that the converging side walls of contiguous base members are essentially in contact at least at one point, and with the cavities 52 being staggered relative to each other as shown in the embodiment of FIGS. 14 to 16 of the drawings. These flanges are then sealingly covered by the flexible cover member 24, as described hereinabove and shown in FIGS. 3 to 5.

With respect to the modified embodiment of FIGS. 10 to 13 of the drawings, in which the reference numerals are the same in identifying components similar to those in FIGS. 6 to 9, the base member 40 is substantially similar to that shown in the embodiment of FIGS. 6 to 9 with the exception that the flange portion 42 is somewhat shorter in the mid-section having the converging side walls 44, 46, and thus providing a somewhat squatter structure with a larger radius of curvature at the narrow end thereof. For the remainder, including the formation of the cavity 52 for the containment of a contact lens and the semi-circular configuration at the wider end surrounding such cavity, the embodiment of FIGS. 10 to 13 is essentially identical with that shown in FIGS. 6 to 9.

As illustrated, the overall dimensions of the flexible cover sheet or member 24 which is sealingly attached to each specific array of blister package base members has external peripheral dimensions which are generally in conformance with the internal dimensions of the lower carton part 12 which is adapted to receive the plurality of superimposed and interleaved, nested arrays 22 of blister packages so as to inhibit any axial shifting and potential damage to the plurality of arrays of blister packages contained therein.

As mentioned previously, the small size and resultingly compact nature of the base members 40 for the blister packages 22 enable the arrays 20 to be considerably smaller in overall size, such as width and length, than with basically rectangular blister packages. Consequently, it is possible to have relatively small-sized cartons contain larger supplies of blister packages and contact lenses than heretofore. Such cartons may easily store up to a 3-month supply of contact lenses without appearing excessively large and ungainly to a potential buyer and consumer.

For instance, as shown in FIGS. 15 and 16, there may be provided a plurality of planar arrays 20 of blister packages 22 as in FIG. 16, and also FIGS. 3 to 5, which are inverted and superimposed into nested positions as shown in FIG. 16, in that embodiment four layers of arrays 20, with each layer having an array of eight blister packages 22, for a total of 32 blister packages, each array interconnected by a single flexible cover member 24, and boxed in a compact elongate carton 10 similar to that shown in FIG. 1 of the drawings.

Figure 17:
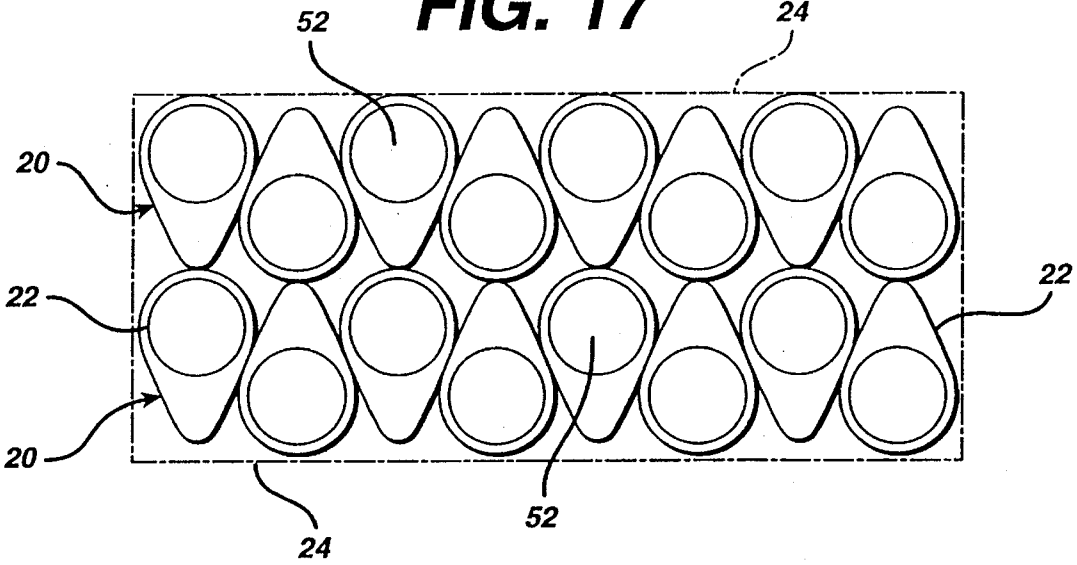
FIGS. 17, 18 and 19 correspond essentially to those shown in respectively FIGS. 14 through 16, however, showing in this instance pluralities of arrays and superimposed layers of arrays of blister packages.
Figure 18:
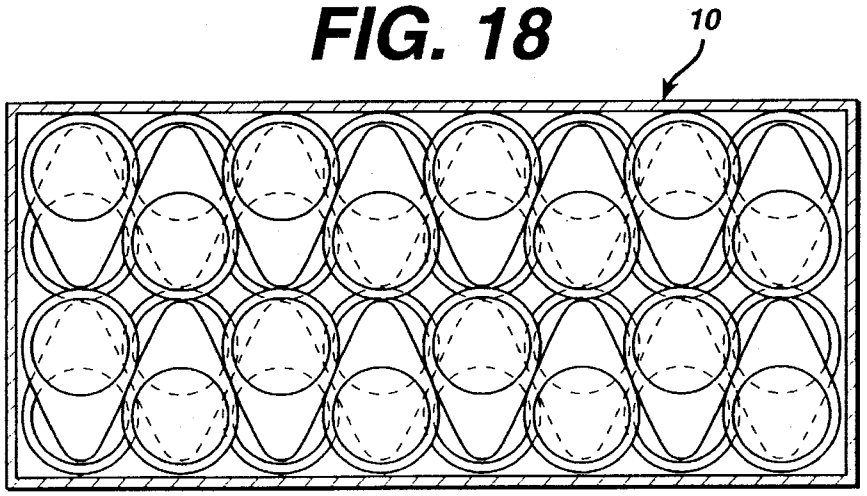
Figure 19:
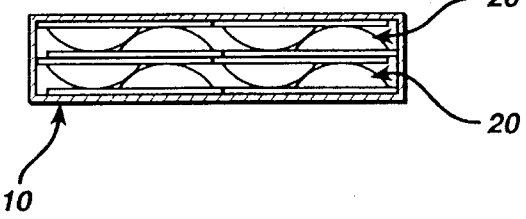

When it is desired to package larger quantities of arrays of blister packages 22 containing contact lenses, for example, as shown in FIGS. 17 to 19, a pair of parallel adjacently located coplanar arrays 20 are each adapted to be interleaved with a similar therebeneath inverted array, and with further subsequent layers of arrays as shown in FIG. 19 of the drawings so as to be positioned in a compact relationship within a rectangular carton 10 of the type shown in FIG. 1 of the drawings. This arrangement may house 64 to 96 blister packages, depending upon the number of layers or arrays 20.

Figure 20:
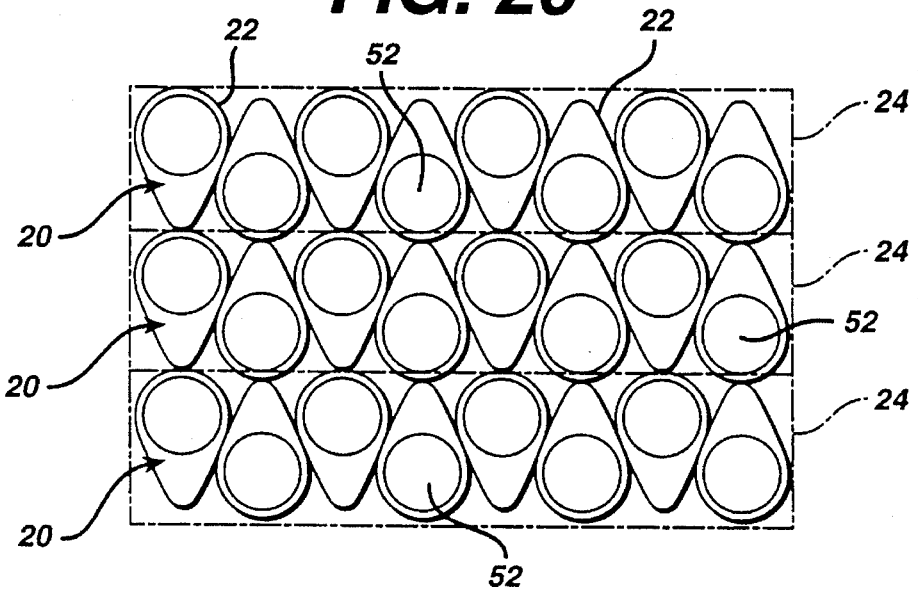
FIGS. 20, 21 and 22 are generally similar to those of respectively FIGS. 17 through 19; however, illustrating pluralities of planar arrays of blister packages, with three rows of arrays being provided in respectively each plane.
Figure 21:
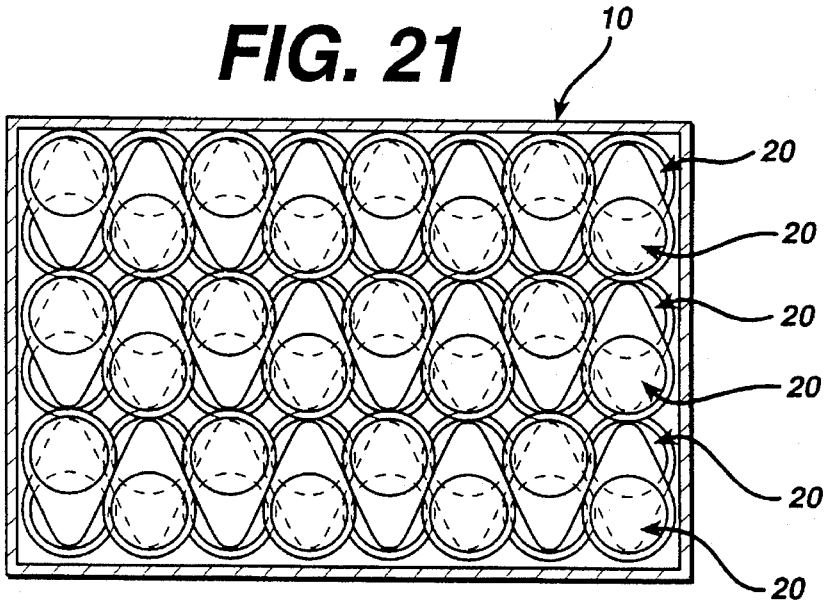
Figure 22:
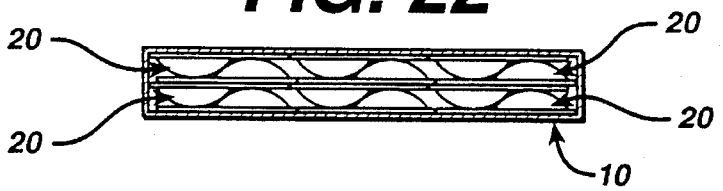
Figure 23:
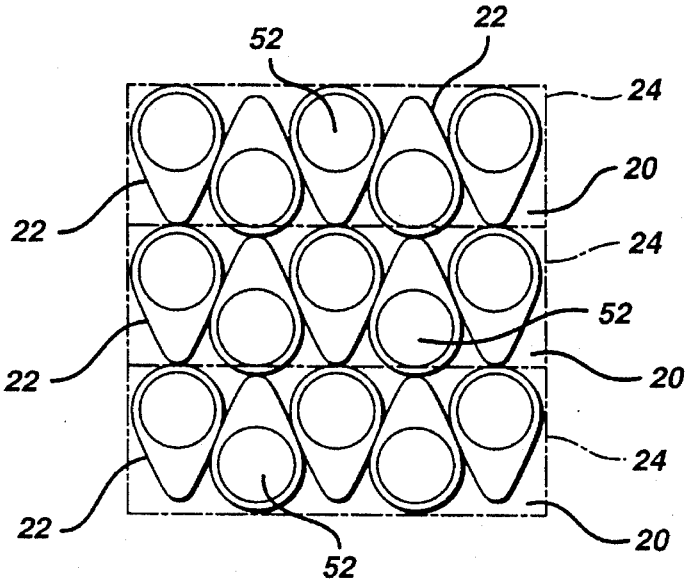
FIGS. 23, 24, and 25 illustrate another arrangement of larger quantities of pluralities of arrays of blister packages similar to those illustrated in respectively FIGS. 14 through 22 of the drawings.
Figure 24:
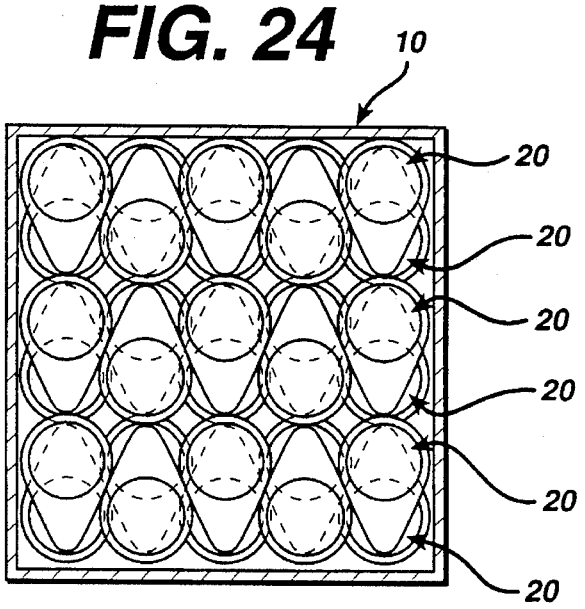
Figure 25:
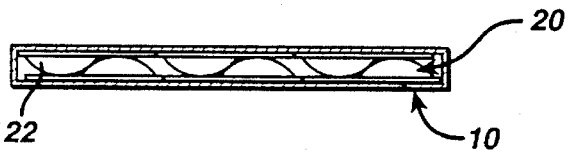
Figure 26:
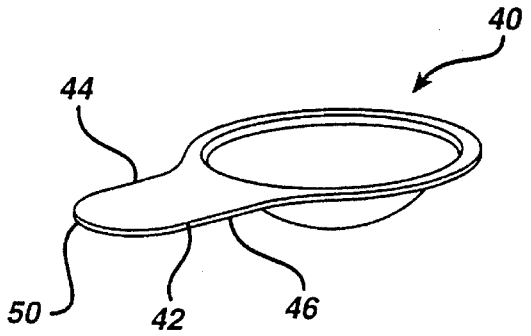
FIGS. 26 through 29 illustrate another embodiment of a base member in a representation similar - to FIGS. 6 through 9 of the drawings.
Figure 27:
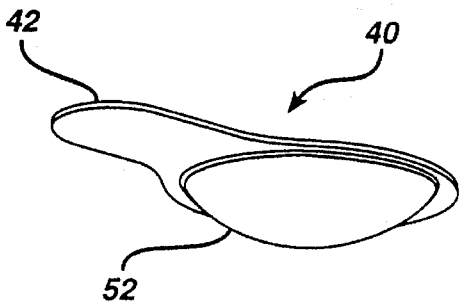
Figure 28:
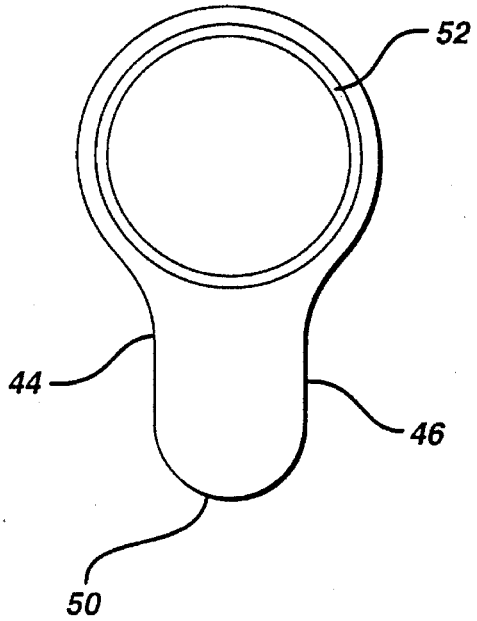
Figure 29:
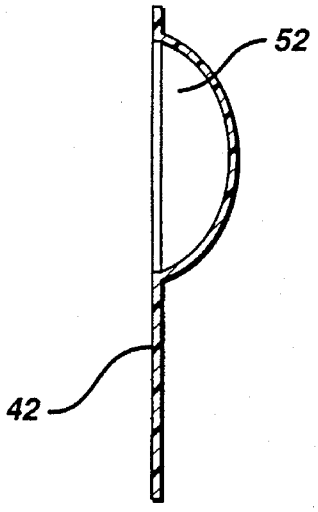
Figure 30:
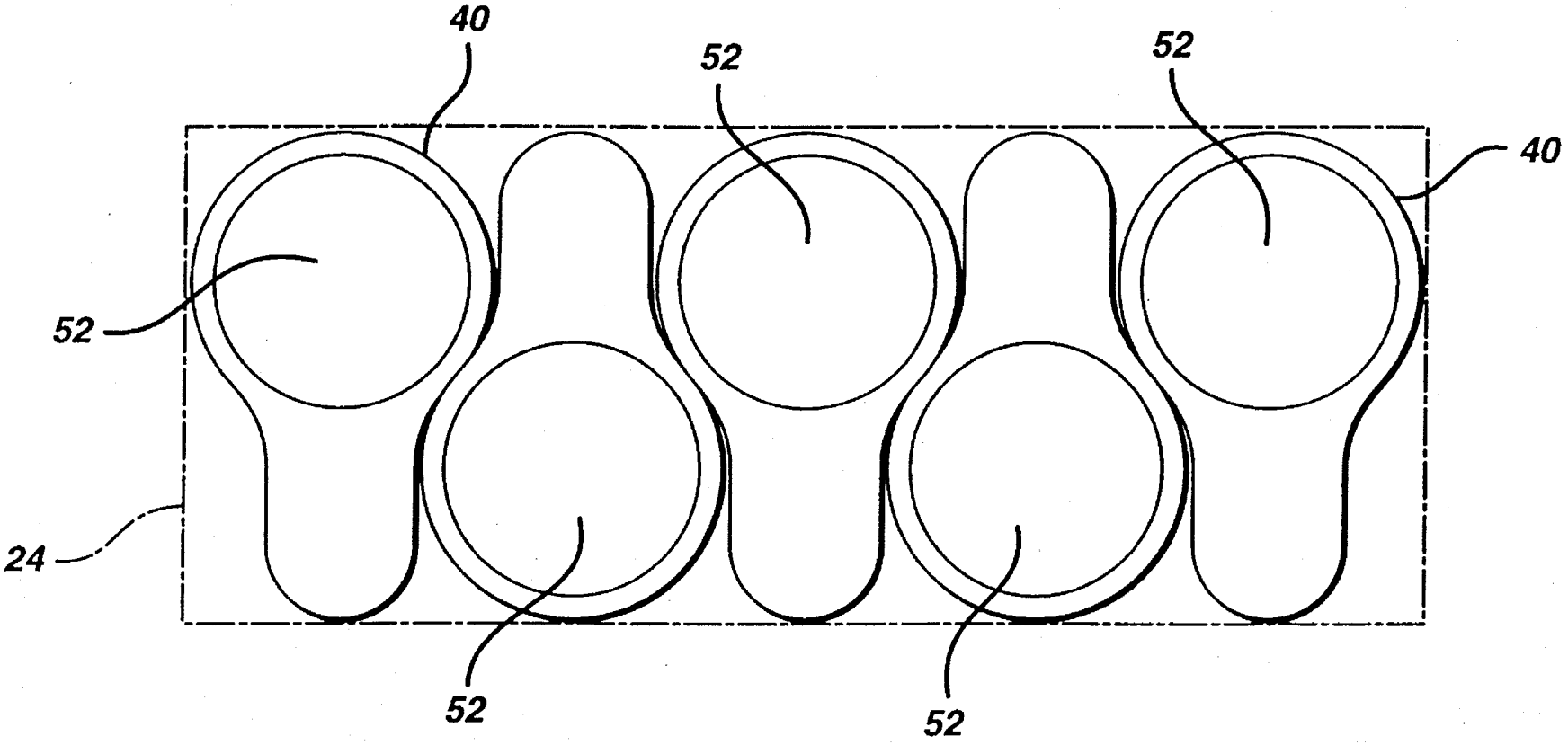
FIG. 30 is a top plan view of an array of blister packages utilizing the base members of FIGS. 26 to 29.
Figure 31:
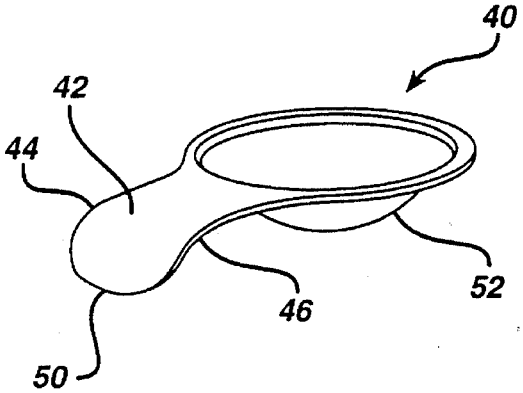
FIGS. 31 through 34 illustrate a fourth embodiment of a base member in a representation similar to FIGS. 6 to 9 of the drawings.
Figure 32:
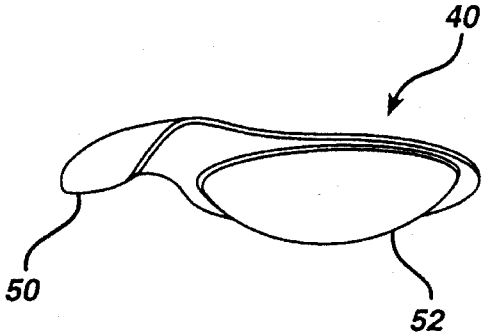
Figure 33:
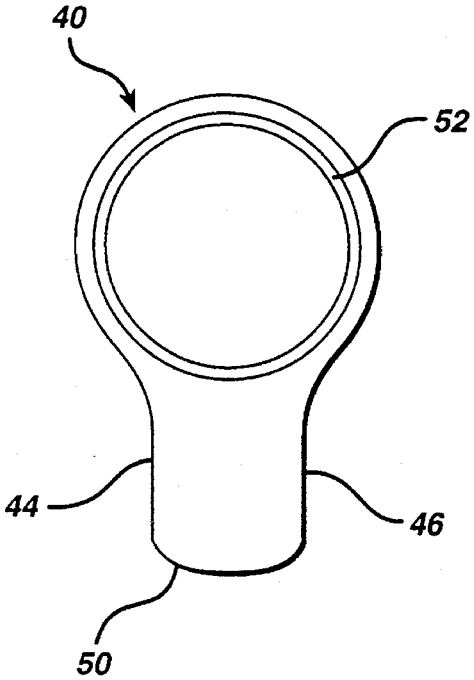
Figure 34:
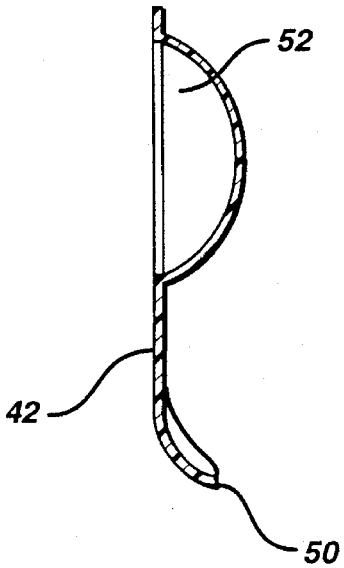

With respect to the embodiments of FIGS. 20 to 22, this discloses a slightly different array arrangement in which the superimposed inverted arrays are provided in three rows for each layer; whereas with regard to FIGS. 23 to 25, this illustrates simply two layers of inverted arrays 20 in a larger-sized but flatter rectangular carton construction.

Referring to the modified embodiment of a base member 40 as illustrated in FIGS. 26 through 29 of the drawings, in which the reference numerals are the same in identifying components similar to those of FIGS. 6 through 9, in this instance the primary distinction relative to the embodiment of FIGS. 6 to 9 resides in that the flange portion rather than being provided with converging sidewalls 44, 46 has the sidewalls narrowed and extending substantially in parallel. This generally defines the shape of a so-called "duckbill," terminating in a rounded end portion 50 opposite to the wider end 48 in which the cavity 52 is located. If desired, the base member 40 of this embodiment of FIGS. 26 through 29 may also be provided with a stiffening rib structure 43 as illustrated in the embodiment of FIGS. 6 through 9.

The foregoing base member 40, in conjunction with other base members of similar configuration and a flexible cover sheet 24, as illustrated in FIG. 1 of the drawings may be assembled in specified arrays; for example, as shown in FIGS. 14 through 25 of the drawings. In this instance, the arrays, which are generally planar in shape, may be of a plurality of rows and also include reversed and inverted superimposed arrays to provide the required quantity of blister packages each containing a contact lens in a secondary packaging.

Similarly, with respect to the embodiment of the base member illustrated in FIGS. 31 through 34 of the drawings, in which elements identical or similar to those in the embodiment of FIGS. 6 through 9 are identified by the same reference numerals, in that instance, the leading edge or end 50 of the parallel sidewalls 44 and 46 may be curved downwardly from the planar upper surface so as to provide an improved strength or rigid configuration upon being assembled in arrays and packaged in secondary packagings. Again, as in the previous embodiments, suitable numbers of base members 40 in this embodiment, covered by a sealing flexible cover sheets 24 may be packaged in various secondary packagings or containments depending upon the number of blister packages which are to be provided with any specific package for use by a consumer, as described with regard to the proceeding embodiments.

The foregoing arrangements of blister package arrays enable the provisions of numerous variations and numbers within respective differently sized carton structures and may be customized in accordance with retail orders received by the manufacturer from ophthalmologists, optometrists, or even from consumers in accordance with their specifications and the types of prescriptions of contact lenses contained in the various arrays of blister packages.

From the foregoing, there is obtained an extremely versatile secondary or composite packaging arrangement for a wide variety of purposes suitable to the specific needs of different consumers and conditions of use.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. A packaging arrangement for the sealed containment of at least one hydrophilic contact lens in a sterile aqueous solution; comprising:

a) a plurality of injection molded or thermoformed plastic base members each having a cavity for containing contact lenses immersed in a solution, each base member including a flange extending outwardly about the periphery of the cavity, the flange having opposite side walls extending between wider and narrower flange ends, the cavity consisting of a generally curvilinear concave indentation in the base member proximate the wider end of the planar flange and having a shape in substantial conformance with the shape of a contact lens adapted to be contained therein; and b) a flexible cover sheet superimposed over the plurality of base members and dimensioned to be detachably sealed to a seal area on the surface of each flange, the cover sheet sealingly extending about each cavity and having unsealed edge portions providing gripping means engageable for enabling separating the cover sheet from each flange so as to expose each cavity and to facilitate external access to the contact lens in each cavity;

wherein the plurality of base members are contiguously arranged and interconnected in an array such that the wider end of respectively one flange is alternatingly positioned adjacent a narrower end of a contiguously located adjacent flange of an adjoiningly located base member, the base members being interconnected by the flexible cover sheet for the containment of a specified number of contact lenses arranged in respectively each cavity of each base member.

2. A packaging arrangement as claimed in claim 1, wherein the side walls of each flange define a narrowing flange configuration for each base member.

3. A packaging arrangement as claimed in claim 1, wherein said side walls are each of a linear configuration extending intermediate the opposite distal ends of each flange.

4. A packaging arrangement as claimed in claim 3, wherein said sidewalls of each flange converge towards a narrower flange end in a generally wedge-like shape from a wider end.

5. A packaging arrangement as claimed in claim 3, wherein said sidewalls of each flange narrow from the periphery of each cavity and extend in parallel relationship towards said narrower flange end.

6. A packaging arrangement as claimed in claim 1, wherein each flange is planar and is downwardly curved at the narrower end thereof.

7. A packaging arrangement as claimed in claim 1, wherein the contiguously located side walls of adjacent each flange are in edge contact with each other.

8. A packaging arrangement as claimed in claim 1, wherein the flexible cover sheet extends over the plurality of base members and is sealingly connected to each flange about at least the cavity of respectively each base member.

9. A packaging arrangement as claimed in claim 8, wherein said flexible cover sheet connects said plurality of base members in a coplanar array.

10. A packaging arrangement as claimed in claim 8, wherein weakening lines are formed in said flexible cover sheet intermediate each of said base members to enable separating said plurality of base members into individual packaging arrangements each having a single said base member.

11. A packaging arrangement as claimed in claim 10, wherein said weakening lines in said flexible cover sheet comprise perforations extending at least partially through said cover sheet.

12. A packaging arrangement as claimed in claim 10, wherein said weakening lines extend along the junctures between contiguous side walls of adjacent of said flanges so as to facilitate separating said base members along lines coextensive with the side walls of said adjacent flanges.

13. A packaging arrangement as claimed in claim 1, wherein the plurality of base members are separable into individual blister packages each containing a single contact lens.

14. A packaging arrangement as claimed in claim 1, wherein the array of base members comprise linearly arranged base members, said flexible cover sheet having a substantially rectangular configuration.

15. A packaging arrangement as claimed in claim 1, further comprising a rigid carton to contain a plurality of the defined array.

16. A packaging arrangement as claimed in claim 15, wherein plural of the defined array are arranged in said carton in superimposed mutually inverted nested relationships.

17. A packaging arrangement as claimed in claim 16, wherein each cavity of each said molded plastic base member is offset towards the wider end of said flange, said superimposed arrays being inverted with respect to the orientation of each other said array to enable the compact nested positioning thereof within said carton.

18. A packaging arrangement as claimed in claim 17, wherein said carton has a generally rectangular configuration.

19. A packaging arrangement as claimed in claim 17, wherein said carton is constituted of one of paperboard, pressed cardboard, and plastic.

20. A packaging arrangement as claimed in claim 19, wherein indicia and content-identifying legends are imprinted on at least one of the exterior surfaces of said carton.

21. A packaging arrangement as claimed in claim 15, wherein said containment is enclosed by a plastic shrink-wrap film.

22. A packaging arrangement as claimed in claim 1, wherein a seal is formed between the cover sheet and the surface of each flange sealingly encompassing the peripheral edge of each cavity.

23. A packaging arrangement as claimed in claim 22, wherein said seal comprises a heat seal.

24. A packaging arrangement as claimed in claim 1, wherein the plastic base members are made from a thermoformable plastic material.

25. A packaging arrangement as claimed in claim 1, wherein the flexible cover sheet is a multi-layered laminate having an outer layer consisting of a plastic film contacting the surface of the flange of the plastic base member.

26. A packaging arrangement as claimed in claim 25, wherein said plastic film is heat sealed to said flange surface of the molded plastic base member for sealing the cavity.

27. A packaging arrangement as claimed in claim 25, wherein said flexible cover sheet comprises a composite foil and plastic film laminate.

28. A packaging arrangement as claimed in claim 26, wherein said flexible cover sheet comprises a barrier layer material intermediate the outer plastic film layer.

29. A packaging arrangement as claimed in claim 1, wherein each base member and the flexible cover conjointly form a moisture and vapor-imperviously sealed containment for a contact lens in said cavity.

* * * * *

UNITED STATES PATENT AND TRADEMARK OFFICE

CERTIFICATE OF CORRECTION

PATENT NO. : 5,620,088

DATED : April 15, 1997

INVENTOR(S) : Martin et al.

It is certified that error appears in the above-indentified patent and that said Letters Patent is hereby corrected as shown below:

Column 14 - Line 1 - change "26" to "25".

Signed and Sealed this

Fourteenth Day of October, 1997

*Attest:*

*Attesting Officer*

BRUCE LEHMAN

*Commissioner of Patents and Trademarks*